US005197495A

United States Patent [19]

Ruppert et al.

[11] Patent Number: 5,197,495

[45] Date of Patent: Mar. 30, 1993

[54] MAKE-YOUR-OWN SYSTEM FOR MAKING A CIGARETTE, ESPECIALLY A FILTER-TIPPED CIGARETTE

[75] Inventors: Heinrich W. Ruppert; Klaus G. Gätschmann, both of Trossingen, Fed. Rep. of Germany

[73] Assignee: Efka-Werke Fritz Kiehn GmbH, Fed. Rep. of Germany

[21] Appl. No.: 344,821

[22] Filed: Apr. 26, 1989

[30] Foreign Application Priority Data

Apr. 28, 1988 [CA] Canada ..... 565438

[51] Int. Cl.[5] ..... A24C 5/40; A24C 5/00; A24F 47/00; A24D 1/02

[52] U.S. Cl. ..... 131/328; 131/330; 131/70; 131/94

[58] Field of Search ..... 131/58, 54, 70, 71, 131/72, 328, 330, 94

[56] References Cited

U.S. PATENT DOCUMENTS 2,930,720 3/1960 Finberg .
3,067,068 12/1962 Finberg .
3,071,476 1/1963 Werft et al. .
3,369,551 2/1968 Carroll .
3,757,798 9/1973 Lambert .
4,431,680 2/1984 Yoshida .

FOREIGN PATENT DOCUMENTS 0123150 10/1984 European Pat. Off. ..... 131/70
0140129 5/1985 European Pat. Off. ..... 131/70
3437882 4/1986 European Pat. Off. ..... 131/70

*Primary Examiner*—V. Millin
*Assistant Examiner*—J. Doyle
*Attorney, Agent, or Firm*—Andrus, Sceales, Starke & Sawall

[57] ABSTRACT

A "make-your-own" system for making a cigarette, especially a filter-tipped cigarette, includes a dimensionally stable tobacco portion (10) matched with the tobacco receiving volume (16) of the cigarette located within a cigarette paper wrapper. The paper wrapper is in the form of a cigarette tube (11) for closely enveloping the tobacco portion (10). The tobacco portion (10) is formed like a cigarillo including an outer wrapper (13) of tobacco or a tobacco blend which imparts to the smoker of the made tobacco portion and therefor to the cigarette approximately the taste and flavor of a factory-made cigarette or a conventional cigarillo clothed as a cigarette.

6 Claims, 1 Drawing Sheet

MAKE-YOUR-OWN SYSTEM FOR MAKING A CIGARETTE, ESPECIALLY A FILTER-TIPPED CIGARETTE

BACKGROUND OF THE PRESENT INVENTION

The present invention concerns a "make-your-own" system for making a cigarette, especially a filter-tipped cigarette, said system comprising a dimensionally stable tobacco portion matched with the tobacco-receiving volume of the cigarette and a cigarette paper wrapper, especially in the form of a cigarette tube, for closely enveloping the tobacco portion.

Cigarette-making by the smoker has been known in various forms for a very long time. This applies chiefly to the so-called "roll-your-own" cigarette making by the use of pieces of cigarette paper provided with a glue-pasted seam. Rolling one's own cigarettes requires some manual skill and is time-consuming. Even with people skilled in rolling their own cigarettes, these vary widely as to size, stability and degree of filling along the length of the cigarette and are only a primitive substitute for factory-made cigarettes. A further drawback is the inevitable crumbling of tobacco, whereby the tobacco yield is reduced. The same problems—even though less severe—exist when roll-your-own appliances are used.

Similar arguments apply to the other basic way of making one's own cigarettes, viz. stuffing one's own cigarettes by means of more or less convenient appliances for introducing a predetermined quantity of tobacco into empty cigarette tubes which normally have a filter tip attached thereto.

A considerable advance in respect of these conventional methods is represented by the proposal made in EP-A-155,514, which originates from the present applicant and which is characterised by a dimensionally stable tobacco portion that is adapted to the tobacco filling of a finished cigarette, wherein the outer surface of said portion is formed by a cover of fully smokable material and the outer surface is air-permeable to such an extent that the tobacco portion itself cannot be smoked but can only be smoked when its outer surface has been closely wrapped with cigarette paper or the like. A tobacco product of similar structure is proposed in EP-A-178,605, wherein according to a preferred embodiment thereof the diameter of the tobacco portion is slightly smaller than the inner diameter of the cigarette paper tube of the finished cigarette so as to facilitate insertion of the tobacco portion into the prefabricated cigarette paper tube. Therefore, in order to achieve the intimate engagement between the tobacco portion and the cigarette paper required for smoking, it is necessary for the user to increase the diameter of the tobacco portion by subsequent mechanical manipulation thereof.

As a wrapper for the tobacco portion, the last-mentioned solutions chiefly propose perforated cigarette paper or perforated tobacco sheet, the latter wrapping material being a paper-based carrier material having tobacco dust glued thereon so that a uniform layer of tobacco dust is formed. But both wrapping materials are characterised by paper which is unnecessary for smoking and also, in the case of the tobacco sheet, by unnecessary binding agent for the tobacco dust, these materials apparently resulting in a corruption of flavour. Also, these wrappers are not ideal in respect of external appearance and a close fit of the tobacco portion within the cigarette paper tube. In particular, the smoker is constrained to consume more paper and, if applicable, binder material than would commonly be the case.

SUMMARY OF THE INVENTION

The present invention is based on the object of providing for the above-specified system a tobacco portion which is fully comprised of tobacco and consequently does not result in any variations of flavour when the made cigarette is smoked, and which in optical respect is immediately apparent as a pure tobacco portion, i.e. one that is fully made from tobacco, and thus is accepted by the smoker as a smokable and in particular a completely palatable product.

In accordance with the present invention the specified object is solved in that the tobacco portion is formed like a cigarillo and consists completely, i.e. inclusive of its wrapper, of tobacco or a tobacco blend, which imparts to the smoker of the made cigarette approximately the taste and flavour of a factory-made cigarette or a conventional cigarillo clothed as a cigarette.

The gist of the invention therefore resides in that the tobacco portion is designed like a cigarillo, i.e. a product which is regarded and recognised by the customer as a completely smokable and in particular palatable product, so that the use of the tobacco portion according to the present invention for making a cigarette by the system according to the present invention does not require any conscious effort on the consumer's side. It is merely necessary to match the cigarillo-like tobacco portion with the dimensions, i.e. length and diameter, of the tobacco receiving volume of a cigarette tube. The same applies to the tobacco quantity. It is preferred that the tobacco portion comprises a tobacco or tobacco blend which imparts to the smoker of the made cigarette in combination with the cigarette paper approximately the taste and flavour of a factory-made cigarette. It is likewise possible, however, by proper choice of tobacco grades and ingredients to achieve a typical cigarillo or cigar taste on smoking of the made cigarette.

The tobacco portion in accordance with the present invention can be made like a conventional cigarillo. Therefore the manufacture of the tobacco portion has no special features which might cause corresponding problems. Finally, the tobacco portion according to the present invention is characterised in many countries by particularly advantageous taxation, viz. that applied to cigarillos. In some countries this is even less than the taxation on a comparable quantity of finely shredded rag which is commonly used for making one's own cigarettes.

In order to permit particularly easy insertion or pushing of the tobacco portion without any auxiliary means into a prefabricated cigarette tube, especially a filter-tipped cigarette tube, the tobacco portion is preferably slightly "pointed" at one end, i.e. it is tapered towards its free end.

The tobacco portion in accordance with the present invention is smokable and palatable both before and after wrapping with cigarette paper, in one case as a cigarillo and in the other case as a cigarette. In this respect, viz. especially by matching with the tobacco receiving volume of a cigarette tube as regards dimensions and tobacco quantity, the tobacco portion according to the present invention is characterised by a surprising dual function. There is no corresponding example in the whole field of tobacco products.

It will be apparent from the above explanations that it is not only the wrapping of the tobacco portion of the present invention but also the remaining structure which shall correspond to that of a cigarillo. Preferably, the cigarillo-like tobacco portion also comprises ingredients which at least in the vicinity of the progressively moving glow zone during smoking cause automatic "spreading apart", i.e. a radial expansion, so that without any subsequent manipulation of the tobacco portion and/or the wrapping by the user—as proposed, for instance, in EP-A-178,605—the required intimate engagement between tobacco and cigarette paper is ensured at any time.

BRIEF DESCRIPTION OF DRAWINGS

Below, the system according to the present invention will be described in detail with reference to the accompanying drawing.

In the drawings.

DESCRIPTION OF THE ILLUSTRATED EMBODIMENT

Figure 1:
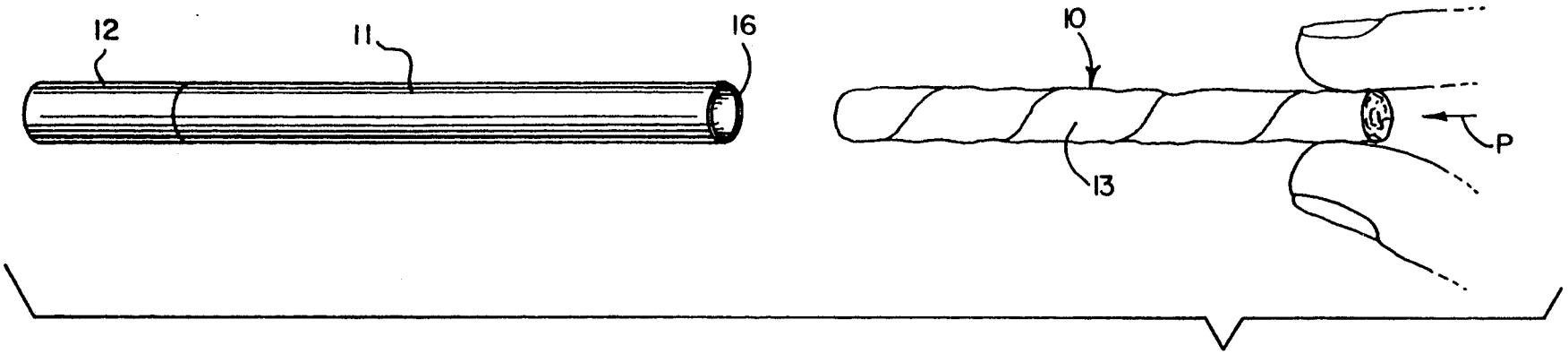
FIG. 1 is an exploded perspective view of the system according to the present invention for making ones own cigarette.

Referring to the drawing, the system according to the invention for making one's own cigarette is shown a prefabricated tobacco portion 10 and a conventional, factory-made filter-tipped cigarette tube 11 comprising a filter tip 12. The dimensionally stable tobacco portion 10 is made like a cigarillo, i.e. it is a cigarillo whose dimensions, i.e. length and diameter, correspond to those of the tobacco receiving volume 16 of the cigarette tube 11. Accordingly, the tobacco portion 10 is smokable and palatable both outside of the cigarette tube 11 in the form of a cigarillo and inside the same as a cigarette. As is usual with cigarillos, the wrapper 13 of the tobacco portion 10 is formed by tobacco leaf material which has been given a surface structure. This surface structure advantageously compensates for any tolerances in diameter of the tobacco portion and/or the cigarette tube such that, when the made cigarette is smoked, practically no secondary air enters between cigarette paper wrapper and tobacco portion, which would result in premature and uncontrolled burning of the cigarette paper. It should be considered in this connection that commercially available cigarette paper tubes exhibit diameter tolerances in the range of $\pm 1/10$ to 2/10 mm. The surface structure of the wrapper 13 moreover ensures a good retaining action of the tobacco portion within the cigarette tube 11, and that even, or precisely, in case of the mentioned diameter tolerances.

Figure 2:
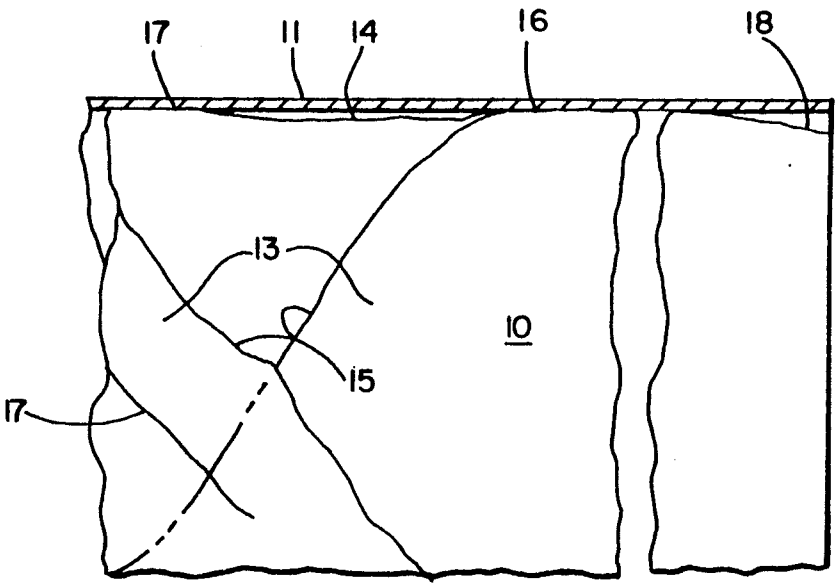
FIG. 2 is an enlarged fragmentary view of a tobacco portion and a cigarette wrapper illustrating a further aspect of the present invention.

As shown in the enlarged diagrammatic view of FIG. 2 2, a cigarillo is typically illustrated forming the tobacco cigarette paper tube 11. A slight gap 14 is shown in the enlarged view between the portion of the cigarillo 10 and the cigarette wrapper 11. The outer sheet or leaf of the cigarillo 13 is formed with a spiral wrap of tobacco leaves, which in actual practice will normally have overlapping spiral edges as at 15. The wrap at the edges may thus be offset slightly as shown at 16. In addition, the surface structure of the typical cigarillo as previously discussed is advantageous, and has certain roughness and/or slight enlargments which are inherent in the tobacco leaf and provide additional surface structure as at 17. These are more or less randomly located and provide enlargements which firmly engage the surface of the tolerance dimensional cigarette wrapper 11. The inventor has thus found that typical commercially available cigarillos can be matched with a standardized cigarette paper wrap in a tubular form to permit the telescopic relationship as shown in FIG. 1 and as described above. In the final result as noted above, the paper wrapper and the cigarillo have effective interengagement which prevent clear longitudinal air passageways which could result in excessive and undesired burning of the paper wrapper relative to the tobacco portion. For optimum results, the spacing should of course be kept to a minimum and clearly for most satisfactory and practical results within the range previously discussed.

In addition, the tip of the cigarillo or tobacco portion 10 often includes a slight tapered end or may be so formed with such an end, as shown at 18 in FIG. 2. The tapered end will further facilitate assembly of the tobacco portion with a preformed cigarette wrapper 11.

The total tobacco quantity of the tobacco portion 10, i.e. inclusive of the wrapper, corresponds approximately to the tobacco quantity of a conventional, factory-made cigarette. This is a further preferred adaptation of a conventional cigarillo to the system according to the present invention, wherein the choice of tobacco is preferably made in such a way that the cigarillo-like tobacco portion after wrapping with cigarette paper imparts to the smoker a taste and flavour to which he/she is used from smoking factory-made cigarettes. The above-mentioned quantitative adaptation of the cigarillo according to the present invention will give the smoker the feeling of smoking an industrially made cigarette when drawing on it. As mentioned above, it is of course possible to vary taste and flavour for instance in such a way that the typical cigarillo taste is retained even after the tobacco portion has been wrapped in cigarette paper.

Since the tobacco portion is made like a cigarillo, it may of course also be smoked without being closely wrapped in cigarette paper. Accordingly, the consumer can choose between smoking a cigarillo (of smaller dimensions) or a cigarette. In the latter case the consumer need only wrap the cigarillo-like tobacco portion with cigarette paper, i.e. either with a conventional piece of cigarette paper of the kind used for rolling one's own cigarettes, or insert or push (see part P in the accompanying drawing) it into a cigarette tube 11 of the kind used for stuffing one's own cigarettes.

In order to ensure intimate or tight engagement of the tobacco portion 10 with the inside of the cigarette paper tube 11 at all times, it is preferred that the tobacco portion should "spread apart" or expand radially during use with a resulting intimate engagement of the tobacco on the cigarette paper, and this should occur at least in the vicinity of the glow zone and progress further as the latter moves while the cigarette is being smoked. Surprisingly, this effect is sufficiently obtained with the embodiment of the tobacco portion. The mentioned expansion of the tobacco in the vicinity of the glow zone may be further promoted by the addition of conventional agents for improving the ability of the cigarette paper to smoulder. In this way perfect burning of the ready-made cigarette along the entire smokable length thereof is ensured even if cigarette paper tube and tobacco portion have larger diameter tolerances.

The above-mentioned structured outer surface of the cigarillo-like tobacco portion 10 also facilitates wrapping with a piece of cigarette paper, since this will not easily slip off when being wrapped about the surface of the tobacco portion 10. In this respect wrapping of the tobacco portion 10 is as easy as wrapping a rope of loose tobacco in the conventional roll-your-own process.

Basically, it would be conceivable to replace the tobacco portion by a tobacco surrogate which is less hazardous to health when smoked than conventional tobacco. The same applies to the wrapper 13 which, by the way, may also be a tobacco sheet having a porosity similar to that of conventional cigarette paper.

All of the features disclosed in the present application documents are claimed as being essential for the invention to the extent to which they are novel over the prior art either individually or in combination.

We claim:

1. A "make-your-own" system for making a cigarette, comprising a hollow tube cigarette paper wrapper (11), a dimensionally stable tobacco portion (10) matched with the tobacco receiving volume (16) of the cigarette and said cigarette paper wrapper whereby said paper wrapper closely envelopes the tobacco portion (10) when said tobacco portion has been inserted into said hollow tube cigarette wrapper, and said tobacco portion (10) including an outer air impervious wrapper of tobacco and being directly smokeable, said tobacco portion including a smokeable product selected from the group of tobacco, a tobacco blend or other natural products, said tobacco portion and said paper wrapper having the taste and flavor of a factory-made cigarette including tobacco particles compacted within a paper wrapper or a cigarillo wrapped in said paper wrapper.

2. The system of claim 1, wherein said outer air impervious wrapper 13 is a natural leaf tobacco.

3. The system of claim 1 or claim 3, wherein said tobacco portion (10) has an outwardly tapered end.

4. The system as claimed in claims 1 or 2 wherein the cigarette paper wrapper is in the form of a preformed tube (11) and having an internal diameter larger than the stable tobacco portion in the range of plus and minus 1/10th to 2/10ths millimeters.

5. The system of claim 1 wherein said tobacco portion (10) is a preformed cigarillo.

6. The system of claim 1 wherein said tobacco portion has an outer structural surface compensating for variation in the diameter of the tobacco portion and controlling air passage between the wrapper and tobacco portion to prevent uncontrolled burning of the wrapper.

* * * * *